US006651398B2

(12) United States Patent
Gregori

(10) Patent No.: US 6,651,398 B2
(45) Date of Patent: Nov. 25, 2003

(54) DECKING ASSEMBLY AND DECKING KIT WITH HOLD-DOWN CLIP

(75) Inventor: Karl H. W. Gregori, Hawkstone (CA)

(73) Assignee: Composite Wood Specialties Ltd., Orillia (CA)

( * ) Notice: Subject to any disclaimer, the term of this patent is extended or adjusted under 35 U.S.C. 154(b) by 0 days.

(21) Appl. No.: 10/228,252

(22) Filed: Aug. 27, 2002

(65) Prior Publication Data

US 2003/0110727 A1 Jun. 19, 2003

Related U.S. Application Data

(63) Continuation of application No. 10/054,541, filed on Jan. 22, 2002, now abandoned, which is a continuation of application No. 09/356,749, filed on Jul. 19, 1999, now abandoned.

(51) Int. Cl.[7] ..... E04B 2/30

(52) U.S. Cl. ..... 52/489.1; 52/650.3; 52/702; 52/712; 182/222

(58) Field of Search ..... 52/177, 480, 483.1, 52/489.1, 650.3, 702, 712; 182/222; 403/231

(56) References Cited

U.S. PATENT DOCUMENTS

| | | | | |
|---|---|---|---|---|
| 1,379,882 A | | 5/1921 | Swartz | 52/489.1 |
| 1,511,764 A | | 10/1924 | Jordahl | 52/489.1 |
| 2,089,865 A | | 8/1937 | Voss | 182/222 |
| 3,530,633 A | | 9/1970 | Scott | 52/489.1 |
| 4,198,042 A | | 4/1980 | Olson | 52/484 |
| 4,620,403 A | | 11/1986 | Field | 52/480 |
| 4,798,029 A | | 1/1989 | Carleton | 52/177 |
| 4,802,553 A | | 2/1989 | Waters | 182/222 |
| 4,852,691 A | | 8/1989 | Bruno | 182/222 |
| 4,965,980 A | | 10/1990 | Leavens | 52/712 |
| 5,076,035 A | | 12/1991 | Wright | 52/400 |
| 5,143,418 A | | 9/1992 | Fouquet | 296/182 |
| 5,205,092 A | | 4/1993 | Taylor | 52/177 |
| 5,234,652 A | | 8/1993 | Woodhams et al. | 264/210.2 |
| 5,274,977 A | | 1/1994 | Bayly | 52/480 |
| 5,351,458 A | | 10/1994 | Lehe | 52/586.2 |
| 5,361,554 A | | 11/1994 | Bryan | 52/480 |
| 5,511,353 A | | 4/1996 | Jones | 52/536 |
| 5,625,985 A | | 5/1997 | Johnson | 52/177 |
| 5,692,345 A | | 12/1997 | Mogaki et al. | 52/483.1 |
| 5,762,441 A | | 6/1998 | Karleson et al. | 182/222 X |
| 5,775,048 A | | 7/1998 | Orchard | 52/712 |
| 5,950,377 A | * | 9/1999 | Yoder | 52/177 |
| 5,953,878 A | | 9/1999 | Johnson | 52/582.2 |
| 6,125,524 A | | 10/2000 | Muller | 29/520 |
| 6,128,880 A | | 10/2000 | Meenan, Jr. | 52/489.1 |
| 6,153,293 A | | 11/2000 | Dahl et al. | 428/310.5 |
| 6,164,024 A | | 12/2000 | Konstantin | 52/200 |
| 6,314,699 B1 | | 11/2001 | West | 52/489.1 |
| 6,484,467 B2 | * | 11/2002 | Crout | 52/483.1 |
| 2002/0056238 A1 | * | 5/2002 | Leines | 52/177 |
| 2002/0095897 A1 | * | 7/2002 | Summerford | 52/489.1 |
| 2002/0121064 A1 | * | 9/2002 | Erwin | 52/586.1 |
| 2003/0009973 A1 | * | 1/2003 | Lee | 52/589.1 |

FOREIGN PATENT DOCUMENTS

| | | |
|---|---|---|
| CA | 2015733 | 4/1994 |

OTHER PUBLICATIONS

Declaration by Karl H. W. Gregori with attached photographs relating to a pre–fabricated decking system sold May 1998.

* cited by examiner

*Primary Examiner*—Bruce A. Lev

(57) ABSTRACT

A decking assembly and decking kit with hold-down clip are disclosed. The decking assembly includes a supporting substructure, first and second lengthwise extending boards with lips extending outwardly and upwardly away from a side thereof and at least one hold-down clip having two downwardly extending tabs which engage the lips of adjacent boards to fix the boards to the substructure. The decking kit includes at least two such boards and at least one such clip, and may additionally include a fastener, such as a screw, and a screwdriver bit.

32 Claims, 4 Drawing Sheets

DECKING ASSEMBLY AND DECKING KIT WITH HOLD-DOWN CLIP

CROSS-REFERENCE TO RELATED APPLICATIONS

This application is a continuation of U.S. patent application Ser. No. 10/054,541 filed Jan. 22, 2002, now abandoned which is a continuation of U.S. patent application Ser. No. 09/356,749 filed Jul. 19, 1999 now abandoned.

FIELD OF THE INVENTION

The present invention relates generally to decking assemblies and more particularly to a decking assembly, and a decking kit including an improved hold-down clip.

BACKGROUND OF THE INVENTION

Decking assemblies typically include horizontal floors raised above the ground. Often such decking assemblies are attached adjacent to residential and commercial buildings. Other uses for such decking assemblies are boardwalks, boat docks, stairs, benches and bridges. Such decking assemblies are often formed from a substructure formed with joists and headers. Several boards of lumber or other material are then typically transversely fixed across the joists of the subframe, in a generally parallel relationship, by way of nails driven through the top surface of the boards.

These decking assemblies, while being adequate for most general purposes, exhibit several shortcomings. These include compromised structural integrity, difficulty in assembly, and limited aesthetic appeal. The use of nails with wooden boards in conventional decking assemblies exhibits each of these problems.

For example, with hammering it is easy to miss the head of the nail and cause unsightly dents and scratches on the top surface of the boards. Additionally, nails are prone to rusting, thus discoloring the top surface of the boards and weakening the nail. This, in turn, compromises the structural integrity of the decking assembly. Also, nails have the tendency to cause wood to split, and to work up from their placements when stressed, further compromising the structural integrity of the decking assembly. Moreover, it is difficult to achieve a uniform spacing for each board.

Other shortcomings of known nail and wood decking assemblies include the vulnerability of wood to dramatic climate changes. The constant expansion and contraction of conventional wood and nail decking assemblies often cause cracking and weakens the entire structure. Additionally, the appearance of nails from the top of the boards of conventional decking assemblies results in an aesthetically displeasing appearance.

One alternative which results in a more visually pleasing deck is to counter-sink the nails and fill the hole with wood plugs. This, however, is expensive and time consuming. Often the plugs work out over time, allowing water to collect and accelerating a rotting process.

Another alternative way of constructing decking assemblies which has been proposed includes the use of a nailing anchor to fix boards to a sub-structure from their bottom surface. Examples of such decking assemblies are disclosed in U.S. Pat. No. 4,620,403 to Field; U.S. Pat. No. 5,775,048 to Orchard; U.S. Pat. No. 4,965,980 to Leavens; and in Canadian Patent number 2,015,733 to Commins. While the use of a nailing anchor may address aesthetic concerns, such assemblies are typically time consuming to assemble. Moreover, they do not address any of the more important structural concerns arising from the use of nails in a wooden structure.

Equally as significant, the use of nails or other fasteners driven into wood boards makes disassembly and repairs of decking assemblies difficult. Moreover, disassembled boards typically include nail markings and holes from previous assembly, and are not easily re-used.

To avoid some of the shortcomings of wooden boards, the use of polymer boards has been proposed. Polymer boards do not rot or decay like wooden boards. However, plastic and polymer boards are much more susceptible to variations in temperatures and are also weakened by the introduction of nails.

Additionally, clip-on boards have been proposed as an alternative to nails. These are usually shaped in such a way as to dictate only one manner of installation. This asymmetry causes problems with installation and maintenance. Additionally, clip-on boards are typically not secure and can be removed without any tools, making them both structurally weaker.

Similarly, tongue and groove boards have been proposed to be used in association with anchor clips which bend into place. However, this often results in a weaker structure with clips that are susceptible to rust and loosening. Moreover, tongue and groove assemblies typically do not allow for drainage of water, that accompanies a typical freeze and thaw cycle.

Accordingly, an improved deck that addresses some of shortcoming of known decking assemblies is desirable.

SUMMARY OF THE INVENTION

An object of the present invention is to provide an improved deck that is easy to construct, aesthetically pleasing and that may be less susceptible to rotting, splitting and decaying than conventional decking assemblies, and that may be use in a variety of climate conditions.

A further object of the present invention is to provide a deck-kit that is conveniently packaged and that may be used to build an improved deck.

Therefore, in accordance with an aspect of the present invention, a decking assembly includes, a supporting substructure; a first lengthwise extending board, having a lengthwise extending first lip extending outwardly and upwardly away from a side of the first board; and a second lengthwise extending board, having a lengthwise extending first lip extending outwardly and upwardly away from a side of the second board. The first and second boards extend on the substructure with the first lip of the first board and the first lip of the second board each extending upwardly and adjacent to each other. At least one hold down clip, is affixed to the supporting substructure and includes a top portion; two downwardly extending tabs extending downwardly defining a medial region between the downwardly extending tabs. The downwardly extending tabs press on the adjacent lips, thereby pulling the first and second boards inwardly toward the medial region to secure the boards to the substructure.

In accordance with another aspect of the invention, a decking kit includes at least two lengthwise extending boards, each including a lengthwise extending lip extending outwardly and upwardly away from a side of the board; and at least one hold-down clip, to be affixed to a supporting substructure. The hold-down clip includes a top portion, two downwardly extending tabs extending downwardly from the top portion, defining a medial portion therebetween. The tabs are for pressing downwardly on adjacent lips of two boards placed on the substructure, thereby pulling the boards inwardly toward the medial portion to secure the first and second boards to the substructure.

In accordance with another aspect of the invention, a hold-down clip includes a top portion; and two downwardly extending tabs extending downwardly from the top portion, defining a medial portion therebetween. The tabs are adapted to press downwardly on adjacent lips of two boards placed on a substructure, thereby pulling the boards inwardly toward the medial portion to secure the boards to the substructure.

Other aspects and features of the present invention will become apparent to those of ordinary skill in the art upon review of the following description of specific embodiments of the invention in conjunction with the accompanying figures.

BRIEF DESCRIPTION OF THE DRAWINGS

In figures which illustrate, by way of example only, embodiments of the present invention.

DETAILED DESCRIPTION

Figure 1:
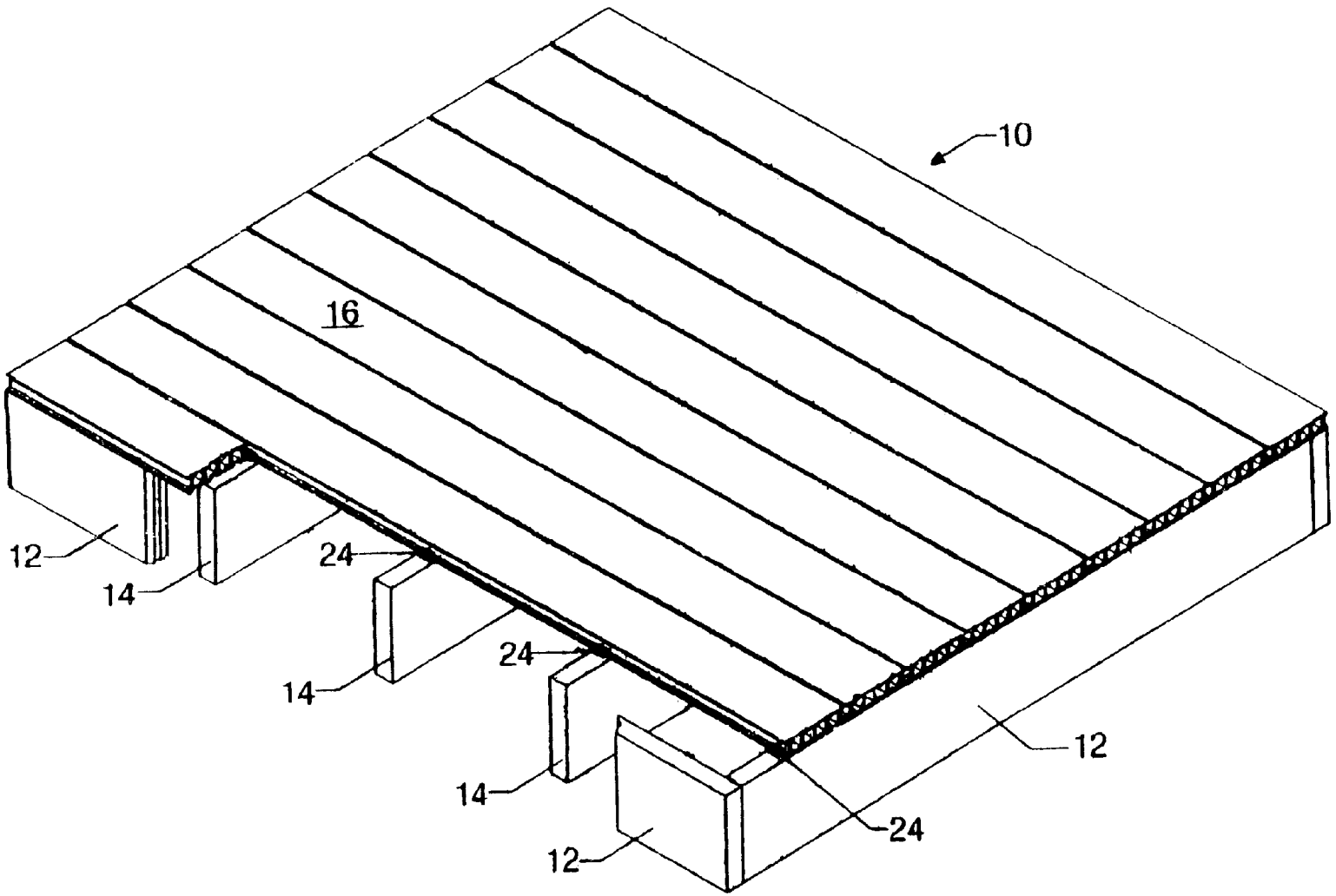
FIG. 1 is a perspective view of a decking assembly, exemplary of an embodiment of the present invention, with parts broken away showing a substructure.

FIG. 1 illustrates a decking assembly 10, exemplary of an embodiment of the present invention. Decking assembly 10 may for example, be used as a residential patio deck, a boardwalk, a boat dock, stairs, a bench or a bridge. Other uses will be apparent to those of ordinary skill in the art.

Decking assembly 10 preferably includes a substructure 11 including headers 12 placed around a plurality of joists 14 spaced evenly apart at a preferred distance of approximately one foot and in a parallel relationship to one another. Transversely placed upon the joists 14 are a plurality of boards 16 spaced evenly apart in a parallel relationship to one another and fixed together and to the substructure 11 by way of hold dozen clips 24.

Figure 2:
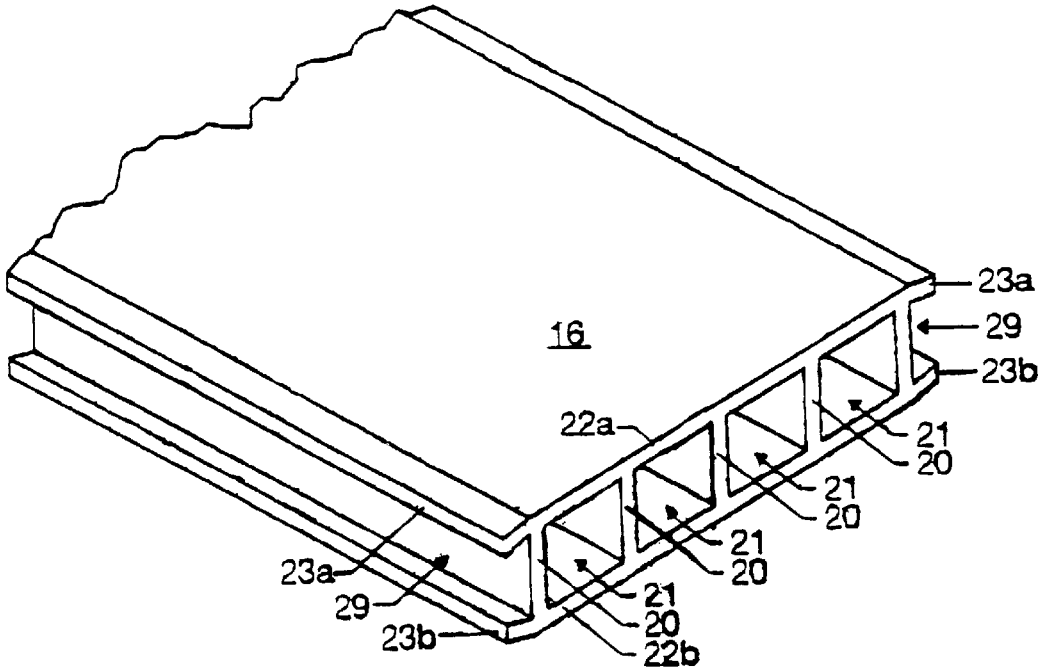
FIG. 2 is a perspective view of a first embodiment of a board that may be used to form the decking assembly of FIG. 1.

FIG. 2 illustrates an example board 16, used to form the decking assembly 10, of FIG. 1. Board 16 is preferably not formed of conventional wood, but is instead formed of composite wood by combining wood particles with a resin and then extruding the mixture through an extrusion mold, resulting in a board 16 containing, a multitude of generally vertical ribs 20 extending lengthwise along each board 16 between two flat surfaces 22*a* and 22*b*, and having a uniform cross-section throughout its length, as for example, detailed in U.S. Pat. No. 5,234,652, the contents of which are hereby incorporated by reference. Ribs 20 are preferably equally spaced apart and define rectangularly shaped chambers 21, extending parallel to one another between flat surfaces 22*a* and 22*b* along the length of board 16. Board 16, when formed of composite wood, has the advantages of being resistant to termites, fungus, rot and decay, resistant to cracking or splintering, is light weight, and reacts well to changes in temperature. As will be appreciated by those of ordinary skill in the art, board 16 may also be formed of other materials such as conventional wood or plastic, and need not be made by an extrusion process.

Preferably, the dimensions of board 16 will be the same as conventional boards of lumber. Preferably, board 16 will be 2"×3"; 2"×4"; 2"×6"; 2"×8"; 2"×10"; or 2"×12" in height and width, and have length which may vary depending on the size of the decking assembly. Additionally, the preferable number of ribs 20 per board 16 is five. Of course, these specifications are merely examples of possible embodiments and many variations of these are possible.

Extending from the sides of each board 16, proximate the edges of each flat surface 22*a* and 22*b* are lips 23*a* and 23*b*, respectively. As illustrated, the top flat surface 22*a* has downwardly angled lips 23*a* extending from either side, and the bottom flat surface 22*b* has upwardly angled lips 23*b* extending from either side. The lips 23*a* and 23*b* preferably extend upward and downward at an angle of about 10° from the horizontal. Preferably, the angled lips 23*a* and 23*b* of the flat surfaces 22*a* and 22*b* extend outward proximate an outermost rib 20 a distance of preferably approximately 0.8 cm. However, as a person skilled in art will appreciate, that such distance and angle may be increased or decreased. Advantageously, as angled lips 23*a* and 23*b* extend from the left and right of top and bottom surfaces 22*a* and 22*b*, boards 16 are symmetrical about vertical and horizontal planes through its center. Opposed angled lips 23*a* and 23*b* form generally dovetailed channels 29, as illustrated. As will become apparent, lips 23*a* and 23*b* need not extend outward linearly but could be curved or have another shape.

Figure 3:
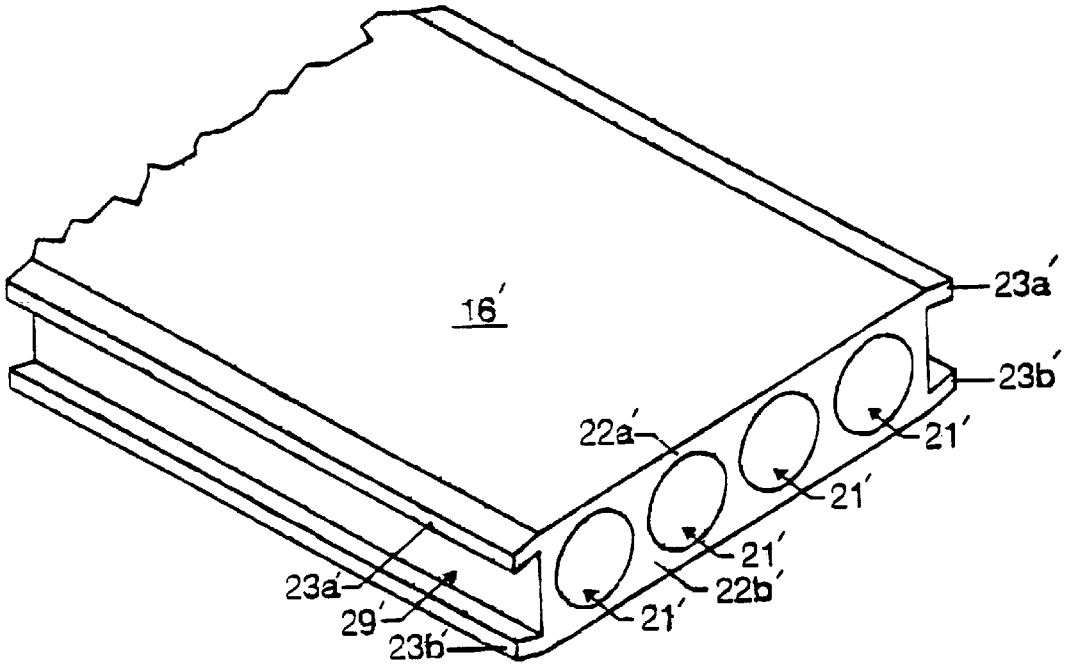
FIG. 3 is a perspective view of an alternative embodiment of a board that may be used to form the decking assembly of FIG. 1.

FIG. 3 illustrates an alternate embodiment of a board 16' suitable for use as part of the decking assembly of FIG. 1. Board 16' includes cylindrical shaped chambers 21', extending parallel to each other between flat surfaces 22*a*' and 22*b*', along the length of the board and angled edges 23*a*' and 23*b*', otherwise possessing the characteristics of the board 16 as in FIG. 2. The chambers 21' are preferably evenly spaced and of uniform diameter. The arcuate ribs 20' provide additional strength to the board 16'. Board 16' may be formed in the same way as board 16, using a suitably shaped extrusion mold.

Figure 4A:
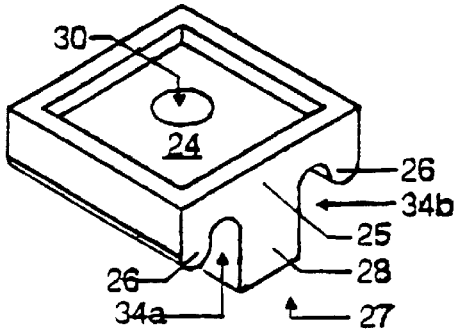
FIG. 4A is a perspective view showing an example of a hold-down clip forming part of the decking assembly of FIG. 1, and exemplary of an embodiment of the present invention.
Figure 4B:
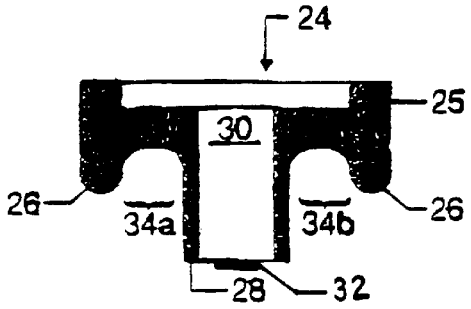
FIG. 4B is a cross-sectional view of the hold-down clip of FIG. 4A.

FIGS. 4A and 4B illustrate, in perspective and cross-sectional view an exemplary hold-down clip 24. Hold-down clip 24 includes a top portion 25. Extending down from top portion 25 of hold-down clip 24 are to downwardly extending outer tabs 26 defining a medial region 27 therebetween. Preferably, extending down, further than the outer tabs 26, parallel to and equidistant to both outer tabs 26 in region 27 is a spacer tab 28. Thus, hold-down clip 24 is generally T-shaped in cross-section, as best illustrated in FIG. 4B. Spacer tab 28 and each outer tab 26 define a channel 34*a* and 34*b* in region 27 extending along the length of clip 24. Clip 24 is preferably made of plastic and may be formed by injection or extrusion molding. Of course, clip 24 could be formed of any other suitable material including a metal or alloy such as aluminum or steel.

Hold-down clip 24 optionally includes a bore 30, extending from the center of top portion 25. Bore 30 is sufficiently large to allow a fastener, such as a nail or screw to pass from the center of the top of clip 24 down through the center of the spacer tab 28. Two small solid disks 32 formed as a result of the injection molding process forming spacer tab 28, protrude from the bottom of spacer tab 28, and are located on either side of the hole on the bottom surface of the spacer tab 28.

Figure 4C:
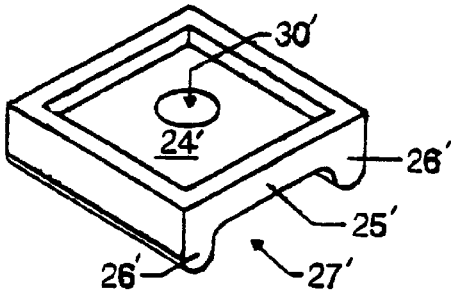
FIG. 4C is a perspective view showing a further example of a hold-down clip that may be used to form part of the decking assembly of FIG. 1.

FIG. 4C illustrates a perspective view of an alternative hold-down clip 24' that may be used in place of hold-down clip 24 of FIGS. 4A and 4B. Hold-down clip 24' has a top portion 25', downwardly extending tabs 26' extending down from top portion 25' defining a medial region 27', and preferably including a bore 30' of sufficiently large diameter to allow a fastener, such as a nail or a screw to pass from the center of top of hold-down clip 24' down through the center of top portion 25'.

Figure 5:
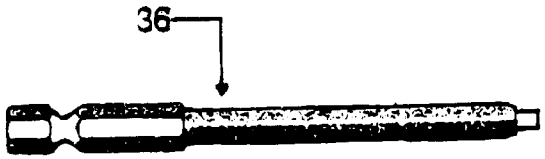
FIG. 5 is a perspective view of a screw-driver bit that may be used to secure the hold-down clip of FIG. 4A to a joist of the substructure of FIG. 1.

FIG. 5 illustrates a screwdriver bit 36 which has its operative end extending a distance preferably at least the distance from the top outer edge of the angled edge 23*a* of flat surface 22*a* of board 16 to the top inner edge of the angled edge 23*b* of flat surface 22*b* of board 16, and most preferably a distance greater than the thickness of board 16. As will become apparent, screwdriver bit 36 has a shaft that is sufficiently thin to allow the adjustment of a screw positioned between two boards 16 while permitting a minimum separation distance between the boards 16. Thus, preferably, the diameter of screwdriver bit 36 will be less than the thickness of spacer tab 28. Screwdriver bit 36 may be a Robertson, Philips, or slotted fit, complementary to screws that may be used to fasten the boards to the substructure 11.

Figure 6A:
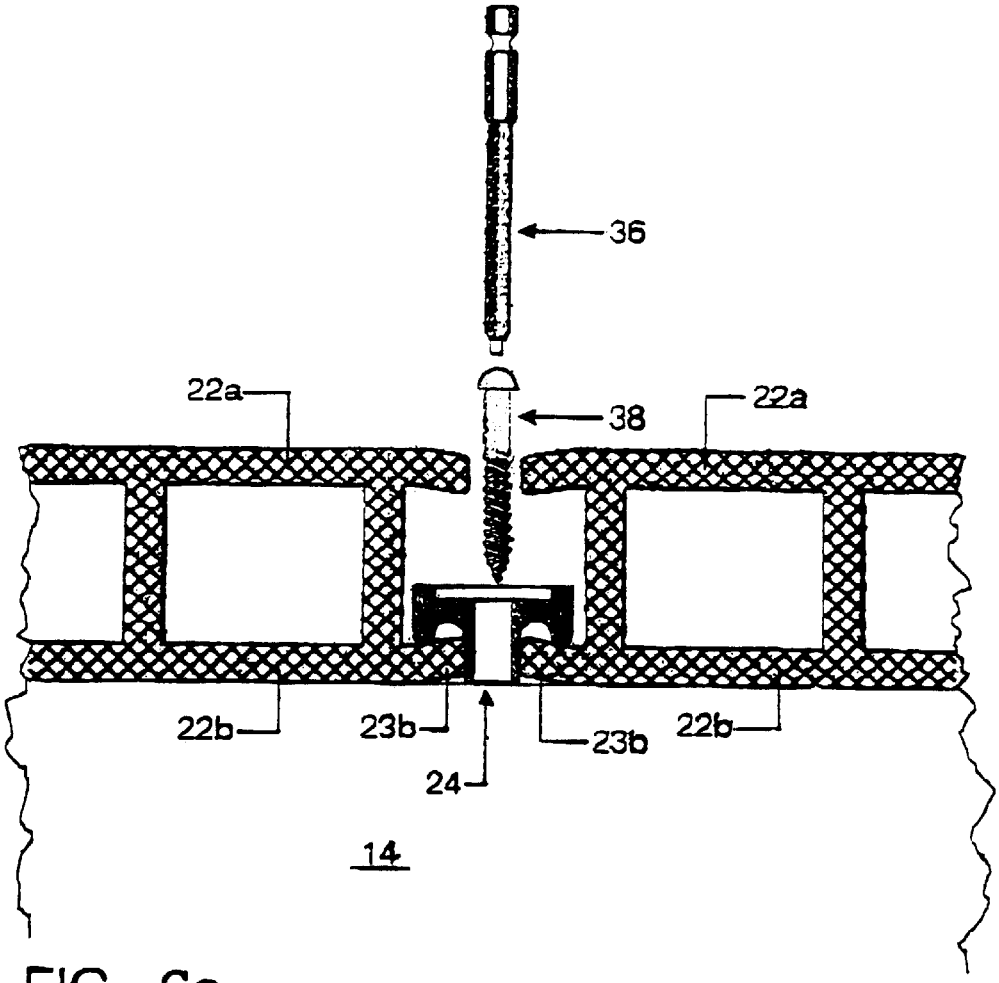
FIG. 6A is a perspective view of two boards of FIG. 2 with a hold-down clip of FIG. 4A in place prior to being fixed to a joist.
Figure 6B:
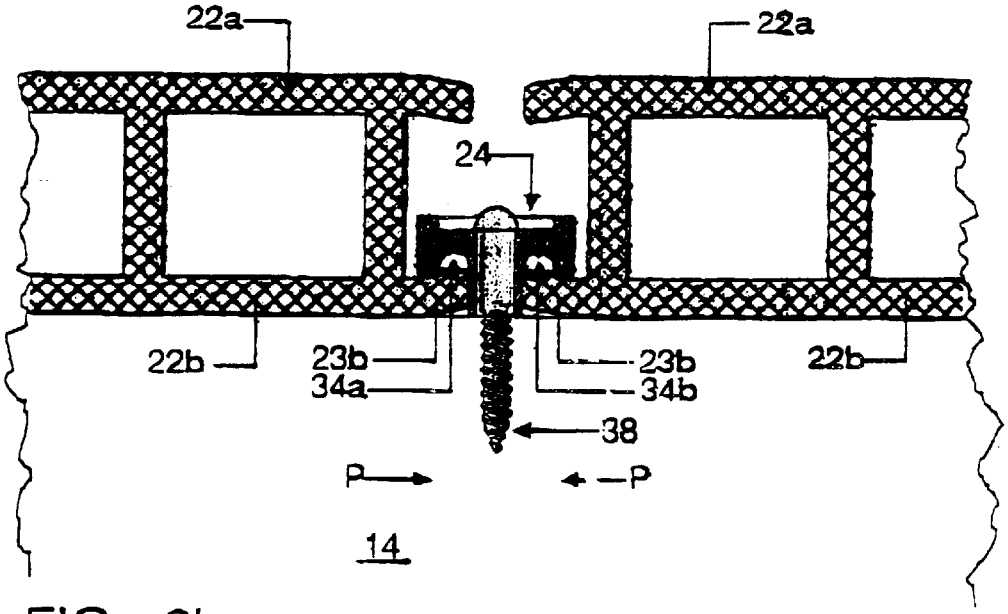
FIG. 6B is a perspective view of two boards of FIG. 2 with a hold-down clip of FIG. 4A in place after being fixed to a joist.

The construction of a decking assembly as illustrated in FIG. 1 using example hold down clip 24 and boards 16 may be better appreciated with reference to FIGS. 6A and 6B. Specifically, FIGS. 6A and 6B illustrate cross-sectional views of a hold-down clip 24 positioned between two boards 16. Boards 16 are placed in a side-by-side relationship on substructure 11, with two lips 23*a* of adjacent boards adjacent to each other. As illustrated in FIG. 6A, hold-down clip 24 is placed above one of joists 14 and between two boards 16 such that the angled lip 23*b* of the bottom flat surface 22*b* of one board 16 is fit within the first groove 34*a* of hold-down clip 24. The angled lip 23*b* of the bottom flat surface 22*b* of another board 16 is fit within the second groove 34*b* of hold-down clip 24. Hold-down clip 24 may be fastened to substructure 11 using a conventional fastener such as a nail, screw, staple or the like. Most preferably a screw, such as screw 38 are used.

Screw 38 is positioned in the top hole 30 of hold-down clip 24 and is turned by a screw driver, preferably fitted with screwdriver bit 36 so that screw 38 is engaged by the complementary bit 36 and driven through the hold-down clip 24 and into the joist 14, causing a downward force to be exerted on hold-down clip 24. The downward force on hold-down clip 24 acting upon the angled edges 23*b* of flat surfaces 22*b* causes a camming force to be exerted on each board 16 in a generally horizontal direction, orthogonal to the downward force, and towards hold-down clip 24 as illustrated by arrow P in FIG. 6B. This, in turn, pulls two adjacent boards close together. Conveniently, the diameter of screwdriver bit 36 is narrower than an extending center spacing tab and is sufficiently narrow to allow the screwdriver bit 36 to fit between adjacent boards as they are pulled together. Spacer tab 28 of the hold-down clip 24 conveniently limits the spacing between adjacent boards. Moreover, spacer tab 28 provides an upwardly directed supporting force, opposite to the downward force of screw 38. As illustrated in FIG. 4C, spacer tab 28 could be eliminated thereby allowing a screw such as screw 38 to act as a spacer between adjacent boards 16.

The combination of the camming force and the downward force causes a strong union between each board 16 and the sub-structure, as well as between each board 16 and each adjacent board 16, resulting in an improved deck. Moreover, hold down clips 24 spaced along the length of the boards may cause adjacent boards to be equally and evenly spaced and parallel, eliminating the need measure or mark the position of boards 16, as they are being assembled. Preferably, several clips identical to hold-down clips 24 are spaced lengthwise at one foot intervals.

Advantageously, hold-down clips 24 need not be fixed from the top surface of boards 16, nor through any surface of boards 16. Each hold-down clip 24 is economical to produce, unobtrusive, and results in an aesthetically pleasing deck.

As boards 16 are symmetrical, downwardly extending lips 23*a* will be adjacent to each other. So arranged, these facilitate water run-off from an assembled decking assembly 10, and additionally prevent uneven board edges that may cause tripping or interfere with snow removal.

As should now be appreciated, if a decking assembly so assembled needs to be disassembled, fasteners may be removed from hold-down clips 24. Boards 16 remain undamaged by any such dissassembly. Moreover, as the boards are symmetrical, any board having a damaged or discolored face may easily be reversed, by loosening the associated fasteners keeping the board in place, and turning the board 180° and thus reversing the board. Similarly, severely damaged boards may be replaced, one by one, as required. This, in turn, may significantly extend the useful life of any such decking assembly.

Conveniently, boards 16, hold down clip 24, and optional screwdriver bit 38 may be packaged as a kit, packaged for distribution and sale. Such a kit may further include suitable instructions, fasteners, such as nails or screws that may be used to attach hold-down clip 24.

The above described embodiments, are intended to be illustrative only and in no way limiting. The described embodiments of carrying out the invention, are susceptible to modification of form, size, arrangement of parts, and details of operation. The invention, rather, is intended to encompass all such modification within its scope, as defined by the claims.

What is claimed is:

1. A decking assembly comprising:

a supporting substructure;

a first lengthwise extending deck board having a side from which a first lip outwardly extends, said first lip having an upper ramp surface extending upwardly away from said side of said first board;

a second lengthwise extending deck board having a side from which a first lip outwardly extends, said first lip of said second board having an upper ramp surface extending upwardly away from said side of said second board;

said first board and said second board extending on said supporting substructure with said first lip of said first board and said first lip of said second board each extending adjacent to each other;

each of said first and said second boards being formed of extruded composite wood;

at least one hold down clip, affixed to said supporting substructure, comprising a top portion;

two downwardly extending tabs extending downwardly from said top portion defining a medial region between said downwardly extending tabs, said downwardly extending tabs pressing on said ramp surface of said first lip of said first board and said ramp surface of said first lip of said second board, thereby pulling said first and second boards inwardly toward said medial region to secure said first and second boards to said substructure;

said at least one hold-down clip being formed from one of plastic, steel and aluminum.

2. The decking assembly of claim 1 wherein each of said hold-down clips is formed of plastic.

3. The decking assembly of claim 1, wherein said first board comprises a second lip extending outwardly from said side of said first board.

4. The decking assembly of claim 3, wherein said second lip has a bottom ramp surface extending downwardly away from said side of said first board.

5. The decking assembly of 4, wherein said second board comprises a second lip extending outwardly from said side of said second board, said second lip of said second board having a bottom ramp surface extending downwardly away from said side of said second board.

6. The decking assembly of claim 4, wherein said first board comprises:

a third lip extending outwardly from a second side of said board, said third lip having an upper ramp surface extending upwardly away from said second side of said first board;

a fourth lip extending outwardly from a second side of said board, said fourth lip having a bottom ramp surface extending downwardly away from said second side of said first board; said first, second, third and fourth lips allowing said first board to be reversed with said fourth lip taking the place of said first lip and the top surface of said first board taking the place of a bottom surface of said first board.

7. The decking assembly of claim 1 wherein each tab terminates in a rounded nose pressing on one said ramp.

8. The decking assembly of claim 7, further comprising a spacer extending downwardly from said center top portion, between said two downwardly extending tabs to a point below the lowermost extent of said tabs, said spacer spacing said boards.

9. The decking assembly of claim 8, wherein said spacer comprises a downwardly extending spacer tab on said hold-down clip.

10. The decking assembly of claim 8, wherein said spacer comprises a screw extending through said hold-down clip.

11. The decking assembly of claim 8, wherein each of said downwardly extending tabs forms a channel with said spacer, and wherein an edge of one of said first lip and said second lip is received in said channel.

12. The decking assembly of claim 7, wherein each of said first and second boards each comprises a plurality of ribs extending lengthwise along a length of each of said first and second boards and vertically between a top and bottom of each of said first and second boards.

13. The decking assembly of claim 12, wherein said ribs are equally spaced apart.

14. The decking assembly of claim 7, wherein each of said boards are formed with a plurality of ribs extending arcuately between two flat surfaces.

15. The decking assembly of claim 7, wherein said hold-down clip is fastened to said substructure by screw.

16. A decking kit comprising:

at least two lengthwise extending deck boards, each board having a side from which a lip outwardly extends, each said lip having an upper ramp surface extending upwardly away from said side of said each board;

said boards being formed from extruded composite wood;

at least one hold-down clip, to be affixed to a support substructure, said hold-down clip comprising:

a top portion;

two downwardly extending tabs extending downwardly from said top portion, defining a medial portion therebetween, said tabs for pressing downwardly on adjacent lips of said two boards placed on said substructure, thereby pulling said boards inwardly toward said medial portion to secure said first and second boards to said substructure;

said at least one hold-down clip being formed from one of plastic, steel and aluminum.

17. The decking kit of claim 16 wherein each of said hold-down clips is formed of plastic.

18. The decking kit of claim 16 wherein each tab terminates in a rounded nose for pressing on one said ramp.

19. The decking kit of claim 7, further comprising a screw to fasten said at least one clip to said substructure.

20. The decking kit of claim 19, further comprising a screwdriver bit for fastening said screw.

21. The decking kit of claim 20, wherein said screwdriver bit is longer than a thickness of at least one of said boards.

22. The decking kit of claim 21, wherein said at least one clip comprises a downwardly extending spacer between said two downwardly extending tabs extending to a point below the lowermost extent of said tabs, to laterally space said two boards on said substructure.

23. The decking kit of claim 22, wherein said screwdriver bit has a diameter less than a thickness of said spacer tab.

24. A decking assembly comprising:

a decking substructure;

a plurality of lengthwise extending deck boards formed of extruded composite wood;

each one of said deck boards comprising, substantially flat top and bottom surfaces;

left and right vertically extending side walls connecting said top and bottom surfaces thereof;

two top fastening lips, one extending outwardly from said right side wall thereof, one extending outwardly from said left side wall thereof, both proximate said top surface thereof;

two bottom fastening lips, one extending outwardly from said right side wall thereof, one extending outwardly from said left side wall thereof, both proximate said bottom surface thereof, each of said two bottom fastening lips having a ramp surface extending upwardly from one of said side walls;

each of said top and bottom fastening lips extending outwardly from a proximate one of said side walls thereof an equal distance, allowing said each one of said deck boards to be reversed;

said deck boards placed adjacent to each other on said substructure, so that top surfaces of adjacent boards create a decking surface, so that bottom fastening lips of two adjacent ones of said deck boards are adjacent to each other;

a plurality of hold-down clips, each for retaining two of said deck boards on said substructure by pressing downwardly on adjacent bottom fastening lips of two adjacent ones of said deck boards;

each one of said hold-down clips comprising:

a top portion;

two downwardly extending tabs extending downwardly from said top portion thereof, defining a medial region between said two downwardly extending tabs thereof, said two downwardly extending tabs thereof pressing on said ramp surface of adjacent bottom fastening lips of said two adjacent ones of said deck boards retained by said hold-down clip, thereby pulling two adjacent ones of said deck boards inwardly toward said medial region thereof to secure two adjacent ones of said deck boards to said decking substructure;

a plurality of fasteners, each fastening one of said hold-down clips and adjacent bottom fastening lips to said substructure, by exerting a downward and lateral force on adjacent ones of said deck boards, thereby holding adjacent ones of said deck boards in place on said substructure; whereby said top and bottom fastening lips and said top and bottom surfaces permit each of said deck boards to be reversed so that top fastening lips may take the place of bottom fastening lips, and bottom surfaces may take the place of top surfaces in said decking assembly, in the event of damage to a top surface of a deck board.

25. The decking assembly of claim 24, wherein each of said hold-down clips comprises a spacer extending downward from a center of said top portion thereof to a point below the lowermost extent of said tabs, said spacer spacing said two adjacent ones of said deck boards retained by said each of said hold-down clips.

26. The decking assembly of claim 24, wherein each of said fasteners comprises a screw extending through said hold-down clip.

27. The decking assembly of claim 24, wherein each of said hold-down clips is formed from one of plastic, steel and aluminum.

28. The decking assembly of claim 27 wherein each tab terminates in a rounded nose pressing on one said ramp.

29. The decking assembly of claim 24, wherein each of said hold-down clips comprises a spacer extending downwardly from its center to a point below the remainder of each clip, said spacer spacing said boards.

30. The decking assembly of claim 24, wherein each of said deck boards further comprises a plurality of equally spaced ribs extending lengthwise along its length, and vertically between its top and bottom surface.

31. The decking assembly of claim 24, wherein opposed top and bottom fastening lips define a dovetailed groove between top and bottom lips of each one of said boards.

32. The decking assembly of claim 24, wherein each of said deck boards is symmetric about a plane parallel to its top surface, extending midway between its top and bottom surface.

* * * * *